US008068025B2

(12) United States Patent
Devenyi et al.

(10) Patent No.: US 8,068,025 B2
(45) Date of Patent: Nov. 29, 2011

(54) PERSONAL ALERTING DEVICE AND METHOD

(76) Inventors: Simon Paul Devenyi, Toronto (CA); Tyler Thomas Devenyi, Toronto (CA)

( * ) Notice: Subject to any disclaimer, the term of this patent is extended or adjusted under 35 U.S.C. 154(b) by 358 days.

(21) Appl. No.: 12/473,601

(22) Filed: May 28, 2009

(65) Prior Publication Data

US 2010/0302033 A1 Dec. 2, 2010

(51) Int. Cl.
*G08B 21/00* (2006.01)

(52) U.S. Cl. ..... 340/540; 340/541; 340/407.1; 340/521; 340/691.1; 340/691.6; 340/692; 324/76.31; 324/76.44; 324/76.55; 324/76.68; 381/56; 381/58

(58) Field of Classification Search ..... 340/540, 340/541, 407.1, 521, 691.1, 691.6, 692; 381/56, 381/58; 324/76.31, 76.44, 76.55, 76.68
See application file for complete search history.

(56) References Cited

U.S. PATENT DOCUMENTS

| | | | | |
|---|---|---|---|---|
| 3,412,378 | A | 11/1968 | Thomas | |
| 3,867,719 | A | 2/1975 | Perrin | |
| 4,408,533 | A | 10/1983 | Owen et al. | |
| 4,759,069 | A | 7/1988 | Bernstein et al. | |
| 4,864,297 | A * | 9/1989 | Shaw et al. | 340/902 |
| 5,278,553 | A | 1/1994 | Cornett et al. | |
| 5,355,350 | A | 10/1994 | Bass et al. | |
| 5,651,070 | A | 7/1997 | Blunt | |
| 5,937,070 | A | 8/1999 | Todter et al. | |
| 6,411,207 | B2 * | 6/2002 | Shaffer | 340/521 |
| 6,518,889 | B2 * | 2/2003 | Schlager et al. | 340/573.1 |
| 2004/0179694 | A1 | 9/2004 | Alley | |

OTHER PUBLICATIONS

Clint Van Zandt, MSNBC TV Crime Analyst and Former FBI Profiler and Hostage Negotiator, Update: Chandra Levy—The Perfect Victim?, Sat Feb. 21, 2009.

* cited by examiner

*Primary Examiner* — Tai T Nguyen
(74) *Attorney, Agent, or Firm* — Bereskin & Parr LLP; Isis E. Caulder

(57) ABSTRACT

A personal alerting device and method for detecting an approaching sound source includes a sound detector for detecting environmental sounds and for providing an electrical signal to a sound analyzer. The sound signal is analyzed to determine a baseline sound pattern comprising a plurality of distinct sounds corresponding to sounds emitted from a reference sound source. The distinct sounds in the baseline sound pattern may have substantially the same amplitude and time interval. The sound signal is monitored and compared against the baseline sound pattern to determine whether a target sound pattern is present in the sound signal, the target sound pattern corresponding to sounds emitted by the approaching sound source. When it is determined that the target sound is present in the sound signal, one or more of an audible, visual and tactile alert may be emitted to provide warning of the approaching sound source.

24 Claims, 4 Drawing Sheets

PERSONAL ALERTING DEVICE AND METHOD

FIELD

Embodiments of the present invention relate generally to a personal alerting device and method, and, more particularly, to a personal alerting device and method for detecting an approaching sound source.

INTRODUCTION

Portable music players and other media devices have become widespread. These devices allow people to enjoy music and other types of media in places that lack ready access to electrical outlets. In particular, people are now more able to enjoy music outdoors while engaging in various outdoor activities, such as jogging or walking. Earphones are often used with these portable music players and provide a convenient and cost-effective way of limiting the amount of noise that is broadcast out into the environment so as not to disturb other nearby persons.

However, music from earphones also tends to interfere with or block out nearby sounds, thereby diminishing the user's awareness of his or her surroundings. Often no significant danger is posed through use of earphones. But it may sometimes happen that users of earphones end up in potentially dangerous situations, where audible warning sounds that would have alerted them to the imminent threat are not heard over the music coming through the earphones. In some instances, the music may drown out the sound made by the footsteps of an approaching person. If the approaching person is a would-be assailant, and/or if the user happens to be in an isolated area at the time, he or she could be vulnerable to attack that would result in serious bodily harm. Joggers who go out late at night or who run through deserted parks alone, for example, may face this risk by listening to music through earphones. Situations like the ones described could potentially even become life threatening for the user. Several such unfortunate incidents have been long reported in the media.

In other instances, earphones can cause the user to not hear the horns from nearby vehicles. Drivers of oversized vehicles especially, such as buses, garbage trucks, and snowplows, often have poor rear sightlines. Consequently there is a potential risk that the vehicle will back up into somebody causing serious bodily harm. Because of the poor sightlines involved, the drivers of these oversized vehicles cannot always be relied upon to avert the potential danger themselves. Even for a person who is not wearing earphones, excessive ambient noise may still drown out or disguise the audible warning sounds that would otherwise have alerted the person to a nearby danger.

Other human senses, most notably eyesight, can also provide a means of detecting imminent danger. However, like hearing, eyesight can also sometimes be limited. Darkness or excessive glare from the sun may diminish a person's ability to perceive dangers. But even in good lighting conditions, a person's normal field of view stops at their peripheral vision, meaning that eyesight is not ordinarily an effective way to perceive dangers that approach from behind. The risks are that much greater when all the above factors are combined, as may be the case for a person who is out for a jog or walk late at night and who is listening to music through earphones.

SUMMARY

The embodiments described herein provide in one aspect, a method of detecting an approaching sound source. The method comprises: a) detecting environmental sounds and providing a sound signal representing the detected environmental sounds to a sound analyzer; b) analyzing the sound signal to determine a baseline sound pattern comprising a plurality of distinct sounds, and storing the baseline sound pattern in memory; c) monitoring the sound signal; d) comparing the monitored sound signal against the baseline sound pattern stored in memory to determine whether a target sound pattern is present in the sound signal, the target sound pattern being related to the baseline sound pattern; and e) providing an alert when it is determined that the target sound pattern is present in the sound signal.

The embodiments described herein provide in another aspect, a system for detecting an approaching sound source. The system comprises: a) a detector for detecting environmental sounds and for providing a sound signal representing the detected environmental sounds; b) a sound analyzer coupled to the detector for receiving the sound signal, wherein the sound analyzer comprises: (i) a signal windowing function for monitoring the sound signal; and (ii) a sound pattern processor for processing the sound signal to determine a baseline sound pattern comprising a plurality of distinct sounds, and for comparing the monitored sound signal against the baseline sound pattern to determine whether a target sound pattern is present in the sound signal, the target sound pattern being related to the baseline sound pattern; and c) an output device coupled to the sound analyzer for generating an alert when the sound analyzer determines that the target sound pattern is present in the sound signal.

The embodiments described herein provide in yet another aspect, a computer program product for use on a computer system to detect an approaching sound source. The computer program product comprises a computer-readable recording medium, and instructions recorded on the recording medium for instructing the computer system, wherein the instructions are for: a) detecting environmental sounds and providing a sound signal representing the detected environmental sounds to a sound analyzer; b) analyzing the sound signal to determine a baseline sound pattern comprising a plurality of distinct sounds, and storing the baseline sound pattern in memory; c) monitoring the sound signal; d) comparing the monitored sound signal against the baseline sound pattern stored in memory to determine whether a target sound pattern is present in the sound signal, the target sound pattern being related to the baseline sound pattern; and e) providing an alert when it is determined that the target sound pattern is present in the sound signal.

Further aspects and advantages of the embodiments described herein will be understood from the following description and accompanying drawings.

DRAWINGS

For a better understanding of the embodiments described herein and to show more clearly how they may be carried into effect, reference will now be made to the accompanying drawings, which show at least one exemplary embodiment, and in which.

Figure 1A:
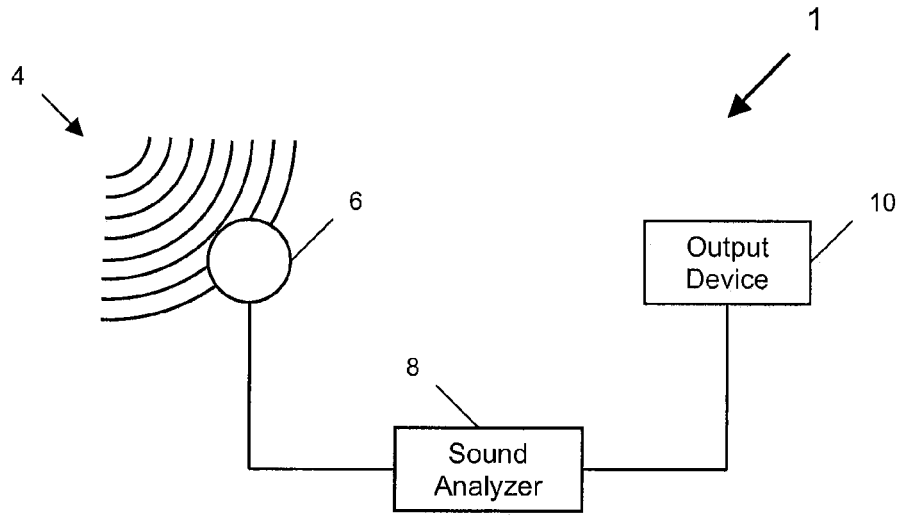
FIG. 1A is a schematic diagram of a system for detecting an approaching sound source.

It will be appreciated that for simplicity and clarity of illustration, elements shown in the figures have not necessary been drawn to scale. For example, the dimensions of some of the elements may be exaggerated relative to other elements for clarity. Where convenient, the elements are sometimes only presented schematically or symbolically.

DESCRIPTION OF VARIOUS EMBODIMENTS

It will be appreciated that for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure, or otherwise convolute, aspects of the embodiments described herein. This description is moreover in no way to be considered as limiting the scope of the embodiments described herein, but rather as merely describing exemplary implementations of the various embodiments.

Reference is first made to FIG. 1A, which schematically illustrates a personal alerting device 1 for detecting an approaching sound source according to an aspect of an embodiment of the present invention. The device 1, which is portable and generally fastened through some means to the user, comprises a sound detector 6, a sound analyzer 8 and an output device 10. Sound detector 6 detects environmental sounds emitted in the vicinity of the sound detector 6, and converts those detected sounds into an electrical sound signal. Sound analyzer 8 analyzes the sound signal provided by sound detector 6 to determine whether or not a target sound pattern can be detected in the sound signal. The target sound pattern may correspond to a sound source 4 that is approaching the sound detector 6, and may be detected by the sound analyzer 8 based on a previously determined baseline sound pattern, which may correspond to a reference sound source in the vicinity of the sound detector 6. The reference sound source may be stationary or moving. In particular, the baseline sound pattern may comprise the sounds made by the user's footsteps, and the target sound pattern may comprise the sounds made by the footsteps of an approaching person. When the sound analyzer 8 detects the presence of the approaching sound source 4 by detecting the target sound pattern in the sound signal, the output device 10 is instructed to emit an alert to the user.

Sound detector 6 is coupled to sound analyzer 8 and comprises a microphone for detecting sound. The microphone converts acoustic waves into an electrical sound signal using a suitable acoustic to electric transducer. For example, the microphone 4 may be a dynamic or condenser type microphone, as well as any other type of microphone that works suitably well in noisy environments. The microphone 4 should be sensitive enough to detect the baseline and target sound patterns even when other sources of ambient (i.e. background) noises are transduced. In some embodiments the sensitivity of the microphone is adjustable and can be set according to the background noise level.

Different microphone directivities may also be selected for the microphone depending on its mount orientation on the user. For example, if the microphone is fastened on the user to be rear facing, then some form of unidirectional microphone, such as a cardioid microphone, may be included in the sound detector 6. If however the microphone is mounted in other or variable orientations, then a bidirectional or omnidirectional microphone may be included. If for example the microphone is worn on the user's wrists, which are constantly changing orientation, then an omnidirectional microphone may be more effective than an unidirectional microphone. It should be understood that microphones having different directivities may be included, but preferably the chosen microphone will have good sensitivity to sound emanating from behind the user. These sounds may represent possible dangers approaching the user, including the footsteps of an approaching person, which the user would not ordinarily be expected to detect using other or faculties, such as eyesight.

The sound signal produced by the sound detector 6 may be an analog signal or alternatively a digital signal. Therefore, in some embodiments the sound detector 6 further comprises an analog to digital converter 28 for generating a digital representation of the analog sound signal transduced by the microphone. The analog to digital converter 28 may also sample the analog sound signal as part of the conversion. It should be understood, however, that an analog to digital converter 28 could equivalently be included in other electronic components of the device 1. As will be seen, in some embodiments the sound analyzer 8 comprises an analog to digital converter 28 for sampling and digitizing the transduced sound signal.

The sound analyzer 8 receives and processes the sound signal generated by the sound detector 6 in order to determine whether or not a target sound pattern is present in the sound signal, corresponding to the sound source 4 in the vicinity of and approaching the sound detector 6. As discussed in greater detail below, the sound analyzer 8 processes the sound signal to determine a baseline sound pattern, and then compares the sound signal against the baseline sound pattern in order to determine if the target sound pattern is present in the sound signal. For this purpose, the sound analyzer 8 also continually monitors the digitized sound signal. Once the sound analyzer 8 positively determines that the sound source 4 is approaching the user, output device 10 is instructed to alert the user of the device 1 to the potential danger posed by the approaching sound source 4. The sound analyzer 8 can be implemented either as software or as hardware components.

The output device 10 is coupled to the sound analyzer 8 and provides one or more different types of alerts when instructed to do so by the sound analyzer 8. For example, the output device 10 may comprise earphones or a speaker for providing an audible alert, which may comprise a verbal message or a series of short beeps. To emit the audible alert, the output device 10 may even interrupt a separate audio stream to better ensure that the alert registers with the user. The output device 10 may also comprise a vibrator for providing the user with a tactile alert. Alternatively the output device 10 may comprise a display for providing the user with a visual alert, such as a sequence of flashing lights. It should be understood that the device 1 may also comprise more than one output device 10 for providing more than one type of alert. Different combinations of alerts may be desirable depending on how the device 1 is physically embodied.

The device 1 may be embodied as a standalone system that is used only for detecting approaching sounds sources. In some embodiments, the sound detector 6, sound analyzer 8 and output device 10 are all included within the same casing, which may be composed of plastic, metal, glass, or any other combination of suitable materials. As mentioned, the device 1 can be mounted on the user in different possible orientations that provide good sensitivity to sounds emanating from behind the user. Accordingly, the device 1 may attach to the waistband of the user's pants using a clip, or alternatively to the user's wrist using a pair of straps and a clasp. The device 1 may also be housed in more than one casing. For example, the sound detector 6 and sound analyzer 8 may be encased together and configured to attach to a waistband, while the output device 10 is encased separately and configured to attach to the user's wrist. In that case, the sound analyzer 8 may send the instruction to the output device 10 wirelessly using short range RF frequencies. It should be understood that different physical embodiments are possible.

Figure 1B:
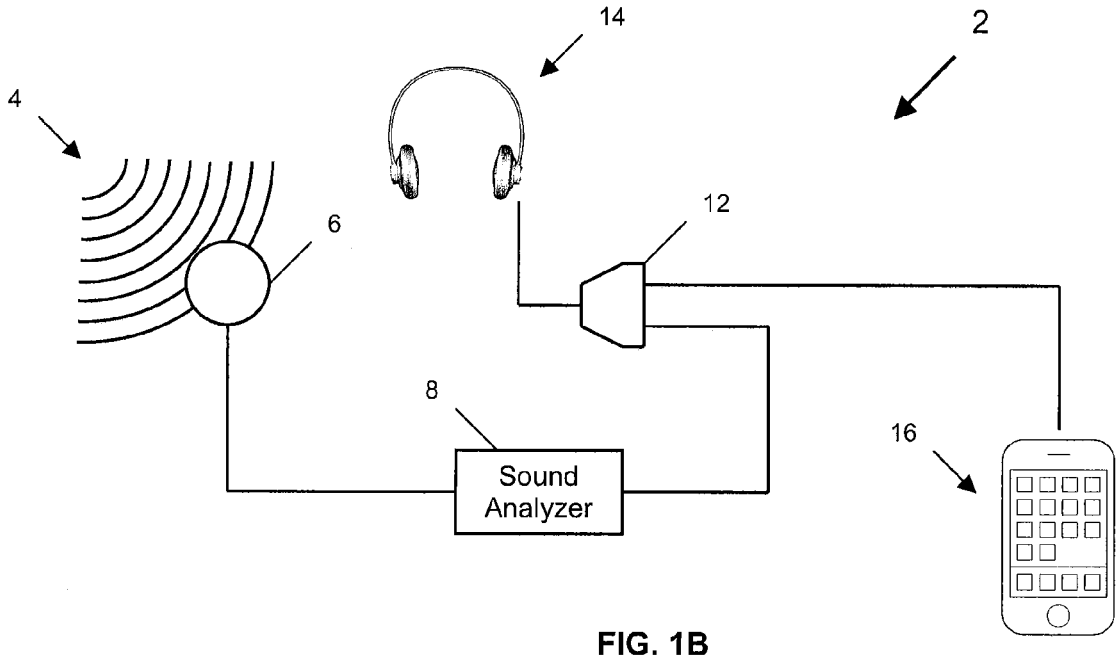
FIG. 1B is a schematic diagram of another system for detecting an approaching sound source.

Reference is now made to FIG. 1B, which illustrates an embodiment of a system 2 for detecting an approaching sound source that is integrated with a portable music player or other audio device. Like components of systems 1 and 2 have been assigned the same reference number and will only be described in as much detail as is necessary. The system 2 generally differs from the device 1 in that the output of the sound analyzer 8 is multiplexed with the audio stream from the portable music player 16, thereby allowing interruption of the audio stream in order to communicate the alert to the user through earphones 14. Device 1 in contrast comprises output device 10 that is dedicated to emitting the alert, whereas in system 2 earphones 14 serve as an output device for both the portable music player 16 (e.g. to play music) and the sound analyzer 8 (e.g. to emit the alert). The audio stream from the portable music player 16 can be interrupted by adjusting its volume and overlaying the audible alert from the sound analyzer 8. Alternatively, the audio stream can be muted altogether to provide the audible alert.

Multiplexer 12 is coupled on its input side to the sound analyzer 8 and the portable music player 16, and on its output side to the earphones 14. In this way, multiplexer 12 can by default select the audio stream from the portable music player 16 and relay it to the earphones 14. However, when given an appropriate instruction by the sound analyzer 8, multiplexer 12 can switch to an alternate audio stream that includes the audible alert. As mentioned, the alternate audio stream may comprise just the audible alert, in which case multiplexer 12 would mute the audio stream from the portable music player 16. Alternatively, the alternate audio stream comprise the audible alert mixed with the audio stream from the portable music player 16, for example the later reduced in volume and overlaid with the audible alert. Accordingly, multiplexer 12 also comprises signal amplifiers, switches, mixers, and other logic circuitry to provide the herein described function.

Sound analyzer 8 and multiplexer 12 can be directly integrated into the hardware and/or software components of portable music player 16. Sound detector 6 may also be integrated into portable music player 16, but it may also be included as a distinct component of the system 2. For example, sound detector 6 may be mounted onto earphones 14 in order to be rear facing. Sound detector 6 may also be integrated with earphones 14. Additional output devices 10 (not shown) may be included in system 2. Alternatively, the sound analyzer 8 and multiplexer 12 may be physically embodied in separate encasings from portable music player 16. In other words, portable music player 16 can be any conventional audio device, and multiplexer 12 can be used to splice the audio stream from portable music player 16 with the output from the sound analyzer 8. In this case, the input jack from the earphones 14 would plug into multiplexer 12 as opposed to directly into portable music player 16.

Figure 2:
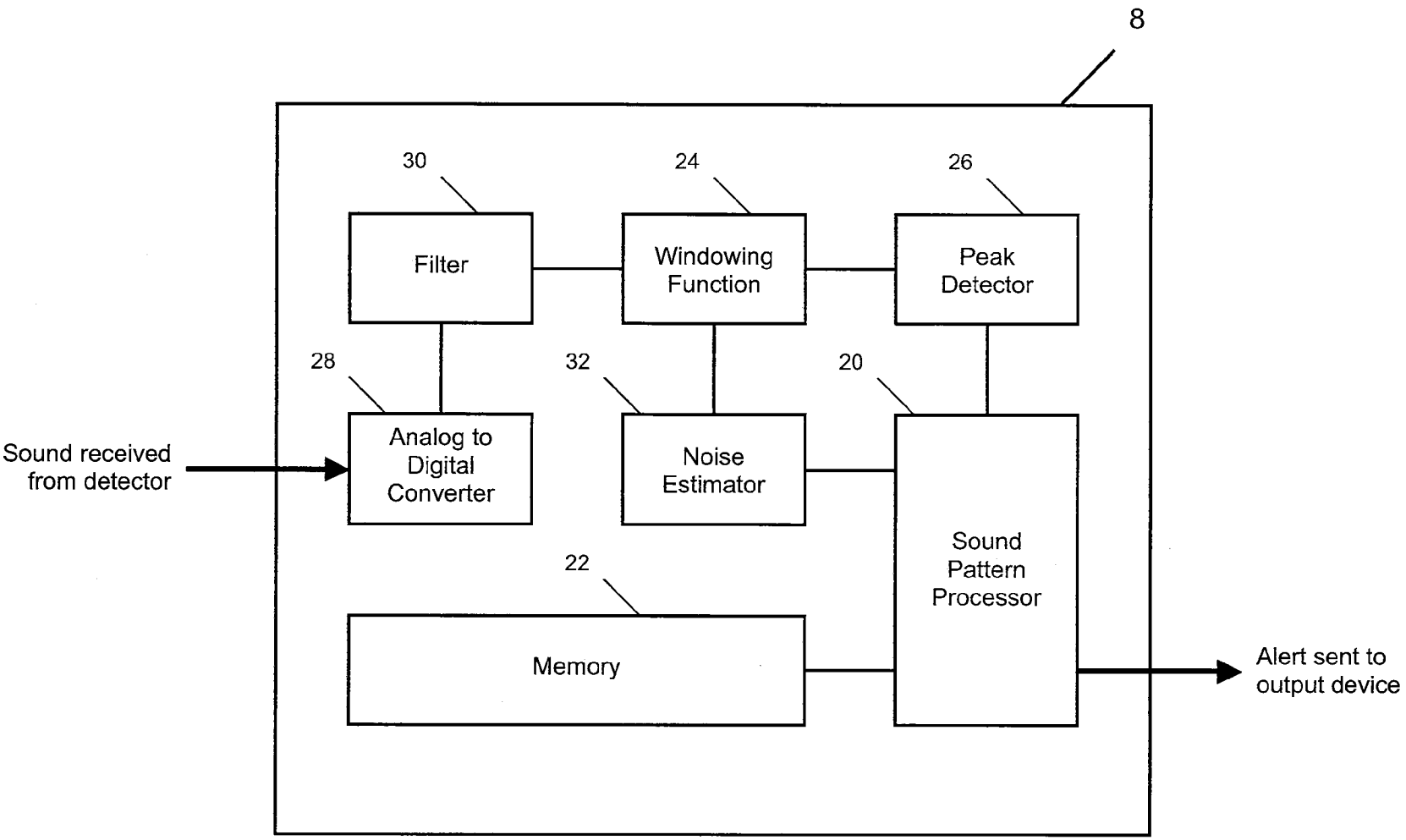
FIG. 2 is a schematic diagram of a sound analyzer included in a system for detecting an approaching sound source.

Reference is now made to FIG. 2, which schematically illustrates a sound analyzer 8 that may, according to aspects of embodiments of the present invention, be included in a system for detecting an approaching sound source, such as systems 1 and 2. As illustrated, the sound analyzer 8 comprises sound pattern processor 20 coupled to memory 22, windowing function 24, and peak detector 26. The sound analyzer 8 receives a sound signal provided by the sound detector 6 and instructs output device 10 to emit an alert whenever the sound pattern processor 20 detects a target sound pattern in the sound signal (corresponding to a sound source 4 approaching the user). The sound analyzer 8 can be embodied on software components, hardware components, or some combination of the two. The sound analyzer 8 may also comprise analog to digital converter 28 for sampling and digitizing analog sound signals. Alternatively, analog to digital converter 28 may be included in the sound detector 6.

The sound analyzer 8 may also comprise filter 30 for preprocessing the digitized sound signal. Filter 30 may provide both a frequency and a gain response. For example, filter 30 may comprise a low-pass or a band-pass filter in order to reduce high frequency (and in some cases also low frequency) noise that is present in the sound signal. Some level of high frequency noise is usually present in analog circuits. Wind in the vicinity of the microphone may introduce low frequency noise. The filter 30 may also provide pre-amplification of the sound signal, as needed, to compensate for the transducer gain of the microphone. As is well understood, filter 30 may comprise a single filter, or alternatively a plurality of filters, and may be implemented as a Finite Impulse Response (FIR) filter.

Windowing function 24 is coupled to analog to digital converter 28 and may be used to store and provide access to present and historical samples of the digitized sound signal. Accordingly, windowing function 24 may be a simple rectangular (also known as a Dirichlet) window with a width of N samples, though other non-rectangular windowing functions are possible as well. The chosen width, N, of the windowing function 24 may depend on the sampling rate of the analog to digital converter 28. However, the width should be chosen such that enough samples of the digital sound signal are resolved in the windowing function 24 for sound patterns (including the baseline and target sound patterns) to emerge and be detected by the sound pattern processor 20.

For example, it may be desirable for the windowing function 24 to resolve about 4 seconds of digitized sound signal (which would correspond to a width of N=4000 if the analog to digital converter 28 samples at a rate of 1 kHz). Note that it may also be convenient for the width of the windowing function 24 to equal a power of two, such as 4096 samples, to reduce computational complexities in the signal processing performed by sound pattern processor 20. Windowing function 24 can be implemented using one or more registers, which, as mentioned, can be embodied in hardware (e.g. using transistor gates) or software (e.g. in computer memory such as memory 22).

The windowing function 24 is used by the sound pattern processor 20 to process the digitized sound signal by storing and providing access to the last N samples of sound transduced by the sound detector 6. Each new sound sample provided by the analog to digital converter 28 replaces the oldest sound sample still stored in the one or more registers. In this way, the windowing function 24 advances one sample each time step, thereby allowing the sound pattern processor 20 to continually monitor the digitized sound signal. In particular, the sound analyzer 8 can monitor the windowed sound signal to detect the presence of the target sound pattern and optionally, as will be seen, to determine new baseline sound patterns.

The sound pattern processor 20 analyzes the sound signal to determine a baseline sound pattern, in other words to discern a baseline sound pattern that emerges in the sound signal. The baseline sound pattern can comprise a plurality of distinct sounds of substantially the amplitude (i.e. loudness) and that are separated by substantially equal time intervals. Thus, any distinct sound from a singular source that is repeated at regular intervals may constitute the baseline sound pattern. It is noted, however, that the respective amplitude and time intervals of the plurality of distinct sounds do not need to be identically equal for the plurality of sounds to form the baseline sound pattern, so long as the respective values of these parameters are substantially equal over the entire plurality of distinct sounds (for example within ±10% of each other over). Other characteristic features of the distinct sounds may also be used in the definition of the baseline sound pattern. Thus, in some embodiments the distinct sounds forming the baseline sound pattern also all have substantially the same pitch, duration, harmonic content, and so on.

The baseline sound pattern determined by the sound pattern processor 20 should comprise at least a minimum of 3 distinct sounds. Starting with a first distinct sound, at least 2 additional sounds would be needed to determine that the distinct sounds had substantially equal amplitudes and were occurring at substantially equal time intervals. Thus no few than 3 distinct sounds should comprise the baseline sound pattern. However, there is no specific limitation on this number. Including a larger number of sounds may increase confidence in the identified baseline sound pattern and provide for more accurate detection of the target sound pattern. In some embodiments, the baseline sound pattern comprises between 3 and 5 distinct sounds. In other embodiments, however, the baseline sound pattern may comprise all such distinct sounds as are resolved by the windowing function 24 at that moment in time.

The sound pattern processor 20 can determine the baseline sound pattern only once during an operating time interval of the device 1. Alternatively, at least once during the operating time interval, the sound pattern processor 20 can dynamically determine a new baseline sound pattern to replace all previous baseline sound patterns. In some embodiments, a new baseline sound pattern is determined periodically during the operating time interval.

For example, the sound pattern processor 20 can determine a new baseline sound pattern at regular intervals of 10 or 30 seconds. The new baseline sound pattern can be determined independently of the previous baseline sound pattern, for example where the update time interval of the baseline sound pattern is longer than the width of the windowing function 24 (in which case the sound pattern processor 20 would no longer have access to the samples from which the previous baseline sound pattern was determined). Alternatively, where the update time interval is shorter than the width of the windowing function 24, the new baseline sound pattern may be determined by updating the previous baseline sound pattern based on the samples of the sound signal in the time since the most recent baseline sound pattern was determined.

In a special case, the sound pattern processor 20 can process the sound at each time step of the windowing function 24, such that the sound pattern processor 20, in effect, updates and maintains the baseline sound pattern in real-time. In this case, for each distinct sound in the baseline sound pattern that passes into and out of the windowing function 24, the sound pattern processor 20 could update the baseline sound pattern accordingly by adding or removing that distinct sound from the pattern. Thus it should be understand that, although the sound pattern processor 20 may continually process the sound signal, not every time step advance will generate a new baseline pattern.

Continual updating of the baseline sound pattern may be advantageous where the pattern has a high rate of change over time. That may be the case, for example, if the distinct sounds forming the baseline sound pattern correspond to the sounds made by the user's footsteps and the user is frequently stopping or changing pace. Continual updating of the baseline sound pattern would provide an effective means of tracking the changes with no or only short lag. Of course, even in embodiments where the new baseline sound pattern is determined periodically at regular intervals, changes in the pattern could also be tracked only with a longer lag.

The sound pattern processor 20 can determine the baseline sound pattern by compiling a log of all distinct sounds that can be isolated in the monitored sound signal. Such a log may list all distinct sounds resolved in the windowing function 24 at a particular time step, including values for each distinct sound corresponding to an amplitude, time, and optionally pitch and duration. The log can be updated and maintained in real-time by adding to and removing log entries as distinct sounds pass into and out of the windowing function 24. Alternatively, the log can be newly compiled once for each time the sound pattern processor 20 is called upon to determine a new baseline sound pattern, or at other regular intervals, for example once every 20 or 50 samples.

Once compiled, the sound pattern processor 20 can parse the log entries (corresponding to different distinct sounds) to determine the baseline sound pattern. The parsing algorithm used by the sound pattern processor 20 should be able to identify, from among all distinct sounds in the log, a plurality (or pluralities) of distinct sounds having substantially the same amplitude and time intervals. Once isolated, selection criteria can be used to select a single plurality of distinct sounds from among the identified pluralities of distinct sounds (assuming the parsing algorithm isolates more than one) to serve as the baseline sound pattern. The selection criteria may comprise expected values for the amplitude, pitch and time interval of the user's footsteps, which may be determined experimentally and inputted during calibration of the sound analyzer 8. In some embodiments, only a single plurality of distinct sounds is identified and taken as the baseline sound pattern without having to apply selection criteria.

The parsing algorithm used by the sound pattern processor 20 may comprise, for each possible grouping of at least 3 distinct sounds in the log, determining a time interval between each pair of successive sounds in the grouping. Statistical means can then be used to determine if the distinct sounds in the grouping have substantially equal amplitudes and time intervals. For example, the sound pattern processor 20 can calculate a mean and standard deviation for each of those two parameters. If the calculated standard deviations are each less than a chosen maximum, indicating that the amplitudes and time intervals for all sounds in the grouping are substantially equal, then the sound pattern processor 20 can determine that the particular grouping of sounds is a possible candidate for forming the baseline sound pattern. The maximum standard deviation can be an adjustable parameter used to provide a finer or coarser parsing algorithm, and it can be defined as a percentage of the given parameter mean.

For example, the maximum standard deviation for substantial correspondence can be 10% of the mean value of the given parameter. Of course, other values are possible as well. Finally, as mentioned previously, if the sound pattern processor 20 identifies two or more candidate groupings, then selection criteria can be used to select one of the groupings as the baseline sound pattern. Once the baseline sound pattern is determined, the sound pattern processor 20 can represent the baseline sound pattern in terms of average amplitude and time interval, as well as is terms of any other characteristic features used in the definition of the baseline sound pattern. These average values can be stored in memory 22.

It should also be understood that the parsing algorithm described herein represents but one algorithm for determining the baseline sound pattern, and that different modifications or variations to the algorithm are possible. It should also be understood that the described algorithm may be used at any time by the sound pattern processor 20 during the operating time interval, and that it would work equally well to determine an initial baseline sound pattern as it would to update the baseline sound pattern or determine a completely new baseline sound pattern. It should also be understood that, with suitable modification as discussed further below, the sound pattern processor 20 should be able to use the same parsing algorithm to detect the target sound pattern.

Peak detector 26 is used by the sound pattern processor 20 to identify distinct sounds in the monitored sound signal, in general, by isolating segments of the sound signal that are characterized by local spectral energy peaks. In other words, segments of the sound signal characterized by greater spectral energy than surrounding segments may be interpreted by the peak detector 26 as comprising a distinct sound. To calculate spectral energy, peak detector 26 can define a sub-window comprising M samples of the sound signal, M being less than N, and then compute the root mean square (rms) of the sound signal over the M samples in the sub-window to represent the average spectral energy of the signal at that time step. Like the windowing function 24, the sub-window may have any suitable shape, including rectangular windows, Hamming windows, and the like. Differently shaped windows, it should be understood, would calculate differently weighted rms values.

An rms value may be determined for each time step to generate a spectral energy signal (i.e. rms spectral energy as a function of time). Peaks in the spectral energy signal will correspond to distinct sounds in the sound signal. Peak detector 26 can detect spectral energy peaks using a suitably configured filter that extracts the rate of change of the spectral energy signal. A sustained positive rate of change followed by a sustained negative rate of change, corresponding to an increase and subsequent decrease in spectral energy, may indicate a spectral energy peak. Because of possible noise and other artifacts in the spectral energy signal, it may be convenient for the filter to include a smoothing function to achieve good results. Once peak detector 26 has detected a spectral energy peak, the sound pattern processor 20 can record the average rms value and center of the spectral peak to represent the amplitude and time of the distinct sound, respectively, and update the log accordingly. The filter used by peak detector 26 can be implemented as a FIR filter and is configurable. Different logic functions may also be used to interpret the output of the filter. For example, spectral energy peaks can be required to have a certain height or width to be interpreted as representing a distinct sound.

It should be appreciated that other filtering techniques may be implemented in peak detector 26 as well. As an example, instead of in addition to tracking rate of change, the peak detector 26 may perform threshold analysis on the spectral energy signal. Segments of the signal wherein spectral energy crosses above a pre-determined threshold value, or comprises a minimum number of samples above the threshold, may be taken to represent a distinct sound. As before, the distinct sound may then be characterized by the average rms value and center of the corresponding spectral peak.

In some embodiments, the sound analyzer 8 further comprises a noise estimator 32 for estimating a level of background noise present in the digitized sound signal. Noise estimator 32 can operate in conjunction with peak detector 26 to isolate distinct sounds in the sound signal. By having the noise estimator 32 determine a noise threshold to represent an estimate of the background noise level in the sound signal, the sound pattern processor 20 can reject, as corresponding to distinct sounds, all spectral energy peaks isolated by the peak detector 26 that fall within the noise threshold of the sound signal. In other words, the sound pattern processor 20 can, for the purpose of determining the baseline sound pattern, simply discard these spectral peaks as artifacts of background noise and not as corresponding to distinct sounds.

The noise estimator 32 can determine the noise threshold as the average spectral energy of the sound signal in the time intervals between distinct sounds. The estimate can be provided, for example, by monitoring the rms spectral energy of the sound signal to isolate segments in which rms spectral energy remains relatively constant at some "low energy level" for one or more sustained periods. The rate of change of the rms spectral energy signal can be determined, as before, using a suitable FIR filter, and the rms spectral energy during these periods can be averaged to provide the noise threshold. During the operating time interval, the noise estimator 32 should converge on a reasonable approximation of the background noise level in the sound signal.

The sound pattern processor 20 uses the baseline sound pattern in determining whether or not the target sound pattern is present in the sound signal. Like the baseline sound pattern, the target sound pattern comprises a plurality of distinct sounds, which, through its characteristic features, can be related to the baseline sound pattern. In other words, distinct sounds that may comprise the target sound pattern can be identified based on, and in relation to, the distinct sounds previously determined as comprising the baseline sound pattern. The converse is true also. Sounds can be rejected as possibly comprising the target sound pattern based on how certain of their characteristic features relate to corresponding features of the baseline sound pattern. Where the sound pattern processor 20 determines that the target sound pattern is present in the sound signal, as mentioned, the output device 10 is instructed to emit an alarm.

In some embodiments, the baseline line pattern corresponds to the sounds made by the user's footsteps. It is a reasonable assumption that, at least over a short period of time, the sounds of these footsteps should have substantially equal amplitude and time interval. The target sound pattern may then correspond to the sounds made by the footsteps of an approaching person or other possible dangers. In that case, the relation between the baseline and target sound patterns may be as follows. The target sound pattern would be characterized by distinct sounds separated by a second time interval, which is shorter than a first time interval by which distinct sounds in the baseline sound pattern are separated, to reflect the fact that the approaching sound source is moving a greater speed relative to the user. The target sound pattern may be further characterized by the amplitudes of the distinct sounds being lower, relative to the amplitudes in the baseline sound pattern, and increasing over time, to reflect the fact that the approaching sound source is getting nearer to the user.

Of course, the target sound pattern can be related to the baseline sound pattern in other ways. The above relation is exemplary only. For example, the above relation would not necessarily hold true if the approaching person has a longer stride length than the user. In such a case, the time interval in the target sound pattern may be equal to or even shorter than the time interval in the baseline sound pattern. Moreover, if the approaching person has a heavier step than the user (which may be the case if the user is walking but the approaching person is running), the amplitudes of the distinct sounds in the target sound pattern may be as large or even larger than in the baseline sound pattern. In these other cases, the baseline sound pattern may be used in positively identifying the target sound pattern as much to negatively filter out other spurious sound patterns attributable to environmental noise. Minimally, the baseline sound pattern may be determined so that sound analyzer 8 does not detect the user's own footsteps as the target sound pattern. Embodiments of the present invention cover all such possible relations between the baseline and target sound patterns.

Using a similar parsing algorithm to the one used in determining the baseline sound pattern, pluralities of distinct sounds can be isolated in the log that have the characteristic features of the target sound pattern, however it is defined. For example, if the target sound pattern comprises sounds of increasing amplitude and shorter time interval than the baseline sound pattern, the sound pattern processor 20 can search over all distinct sounds in the log fitting those criteria. Pluralities of distinct sounds, even ones sharing certain other characteristic features, can be rejected. If the sound pattern processor 20 isolates the target sound pattern, it can then instruct the output device 10 to emit the alarm, thereby alerting the user to a possible approaching sound source 4.

The baseline and target sound patterns detected by the sound pattern processor 20 have been described as comprising a plurality of distinct sounds characterized by certain characteristic features of the sounds, e.g. amplitude, time interval, pitch, duration. It should be understood that different sound patterns could be detected by the sound pattern processor 20 with suitable modification. For example, the sound pattern processor 20 may detect more complex patterns of distinct sounds, as well as single or harmonic frequency noises, such as sirens and other forms of sustained sound. In such cases, the sound pattern processor 20 may not necessarily determine a baseline sound pattern and may instead directly detect the target sound pattern in the sound signal. The sound pattern processor 20 can be configured to detect a wide variety of different sound patterns.

Figure 3A:
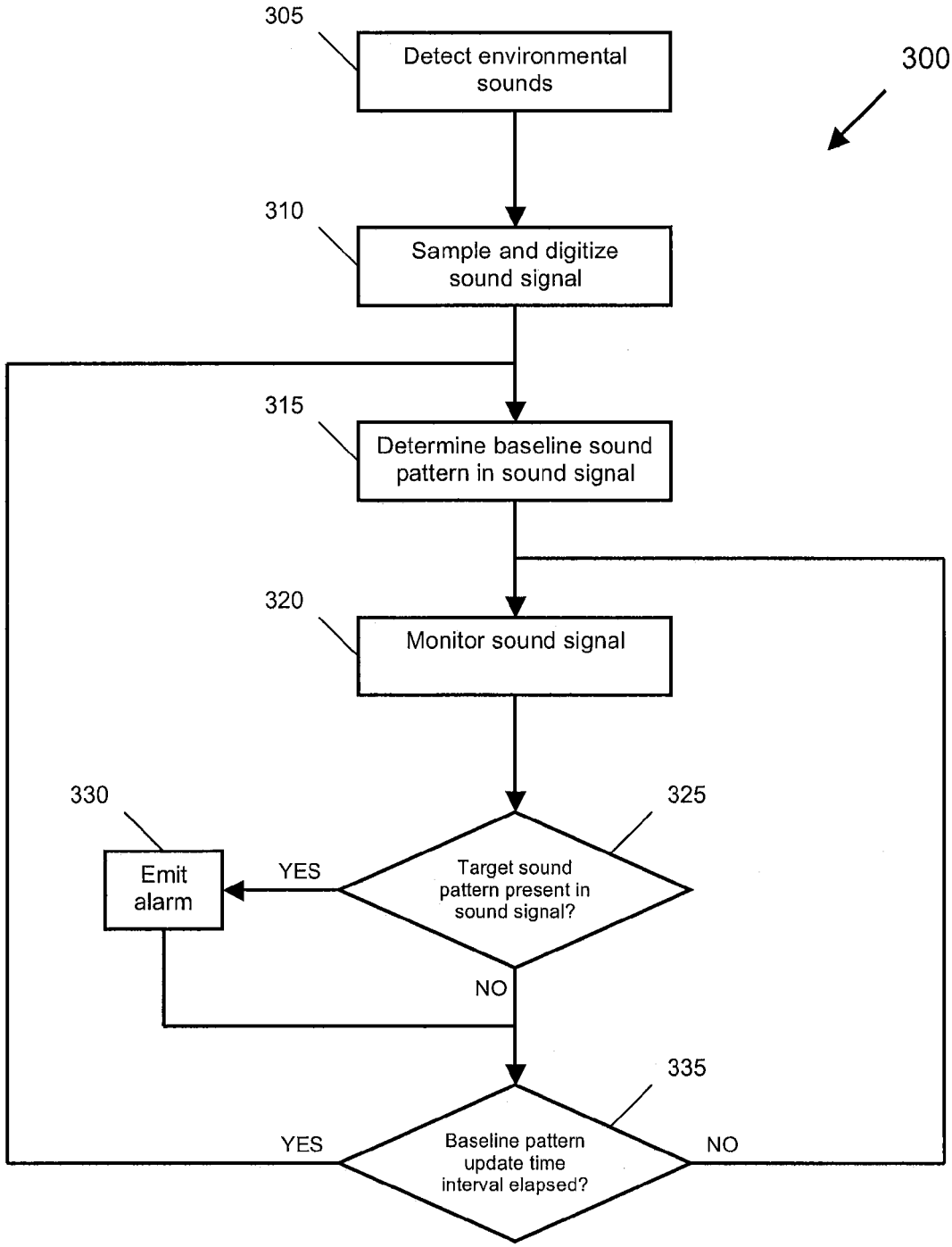
FIG. 3A is a flowchart illustrating the steps of a method for detecting an approaching sound source.

Reference is now made to FIG. 3A, which illustrates the steps of a method 300 for detecting an approaching sound source according to an aspect of an embodiment of the present invention. It should be appreciated that the steps of method 300 can be performed generally by suitably configured hardware or software components. In particular, the steps of method 300 can be performed by different components of systems 1 and 2, including the sound pattern processor 20. It should also be appreciated that certain steps of the method 300 can be modified or removed altogether to provide variations of method 300, all of which relate to different embodiments of the present invention.

Step 305 comprises detecting environmental sounds using a sound detector, such as a microphone or other acoustic to electric transducer. The microphone should be sensitive enough and correctly oriented in order for a certain sound pattern of interest to be detected. In some embodiments, the sound pattern of interest comprises the sounds made by a person's footsteps. Once transduced into an electrical signal by the microphone, the detected sound signal is transmitted to a sound analyzer for signal analysis in subsequent steps of method 300.

Step 310 comprises sampling and digitizing the electric sound signal provided by the microphone in step 305. A suitably configured analog to digital converter (ADC) can be used. For example, the ADC can comprise any of a direct conversion, successive approximation, or delta-encoded analog to digital converter. The chosen ADC should have sufficient precision and a fast enough sample rate so as to provide a reasonably good digital approximation of the sound signal. Minimally the digital representation should be good enough so that the digitized sound signal is processable to determine sound patterns occurring therein.

Step 315 comprises analyzing the digitized sound signal to determine a baseline sound pattern. In some embodiments, the baseline sound pattern comprises a plurality of distinct sounds, wherein the distinct sounds have substantially the same amplitude and are spaced apart in time by substantially equal time intervals. At least three distinct sounds should be included in the plurality in order to form the baseline sound pattern, but there is no general restriction on the number of distinct sounds that may form the pattern. In some embodiments, there are between 3 to 5 distinct sounds. A suitably configured microprocessor or hardware component, such as a Field Programmable Gate Array (FPGA), can be used in determining the baseline sound pattern.

Determining the baseline sound pattern in step 315 can comprises applying a windowing function to the digitized sound signal in order to store and provide access to present and historical values of the signal, compiling a log of all distinct sounds that are resolved by the windowing function, and searching across all distinct sounds in the log using statistical means to identify a plurality (or pluralities) of distinct sounds having substantially equal amplitudes and time intervals. If needed, selection criteria can be applied in order to select a single plurality of distinct sounds from among multiple pluralities of distinct sounds to serve as the baseline sound pattern. Compiling the log of all distinct sounds resolved by the windowing function can comprise generating a spectral energy signal for the sound signal by calculating the average rms spectral energy of the signal as a function of time, wherein peaks in the spectral energy signal correspond to distinct sounds in the sound signal. Searching across all distinct sounds in the log can comprise, for each possible grouping of at least three distinct sounds, calculating a mean and standard deviation for the amplitudes and time intervals of the spectral peaks in the grouping, in order to identify groupings of distinct sounds whose amplitudes and time intervals have a standard deviation that is less than some chosen maximum.

Step 320 comprises monitoring the sound signal by continually detecting, sampling and digitizing environmental sounds to provide a real-time digital signal representing environmental sounds detected in the vicinity of the sound detector. Only the N most recent samples of the signal may be stored by applying the windowing function to the real-time digital signal, thereby making the data flow in the microprocessor more manageable. As described in more detail below, the monitored signal can also be used to update the baseline sound pattern or to determine a completely new baseline sound pattern. Additionally, the monitored sound signal can be processed to detect a target sound pattern present in the sound signal. That determination can be made in decision 325 using similar steps as in the determination of the baseline sound pattern.

In some embodiments, the target sound pattern comprises a plurality of distinct sounds, wherein the amplitudes of each distinct sound are increasing and lower than the amplitudes of the distinct sounds in the baseline sound pattern. The distinct sounds in the target sound pattern are also separated by a second time interval that is shorter than a first time interval separating distinct sounds in the baseline sound pattern. Accordingly, determining whether the target sound pattern is present in the monitored signal comprises isolating a plurality of distinct sounds in the sound signal that satisfy the required relation to the baseline sound pattern by performing a similar search over all possible groupings of distinct sounds using a similar parsing algorithm.

If it is determined in decision 325 that the target sound pattern is present in the monitored sound signal, then method 300 branches to step 330, in which an alarm is emitted. The type of the alarm that is emitted alarm can vary. In some embodiments the alarm is an audible alarm, while in other embodiments the alarm is a visual or a tactile alarm. When the alarm is an audible alarm, emitting the alarm may sometimes comprise quieting, muting or otherwise interrupting a music stream from a portable music player, and overlaying the audible alarm. It is also possible in step 330 to emit multiple alarms of different types sequentially or simultaneously. Thus, it is possible for example to provide the user with an audible alert together with a vibratory alert applied to the skin or body.

If however it is determined in decision 325 that the target sound pattern is not present in the monitored sound signal, then method 300 branches to decision 335, in which it is determined whether or not an update time interval for determining a new baseline sound pattern has elapsed. It should be appreciated that decision 335 may be omitted from some embodiments of method 300 wherein the baseline sound pattern is only determined once. On the other hand, if a new baseline sound pattern is to be determined periodically to replace all previous baseline sound patterns, decision 335 may be included. New baseline sound patterns may be determined to account for the possibility that one or more characteristic features of the baseline sound pattern may change over time. For example, if the baseline sound pattern corresponds to the user's footsteps, over time the pattern may change with the user's changing stride length, as might happen if the person begins to jog or run.

If it is determined in decision 335 that the update time interval has elapsed, then method 300 branches back to step 315 for determination of a new baseline sound pattern, and from there the method continues as described. If however it is determined in decision 335 that the time interval has not elapsed, in which case the existing baseline sound pattern may still be used, then method 300 branches back to step 320 for monitoring of the sound signal, and from there the method continues as described. It should be understood that in some embodiments, as the baseline sound pattern is only to be determined once, decision 335 is omitted altogether. In that case, the branch of decision 325 leading to decision 335 instead can lead back to step 320 for monitoring of the sound signal.

It should also be understood that method 300 may start with step 305 or alternatively some form of initialization step and, though not shown explicitly, that method 300 may stopped by exiting one of the two parallel loops branching out of decision 335 using some chosen stop condition, like an on/off button. Finally, it should also be understood that method 300 has been presented to be exemplary only and may comprise other additional steps not explicitly illustrated.

Figure 3B:
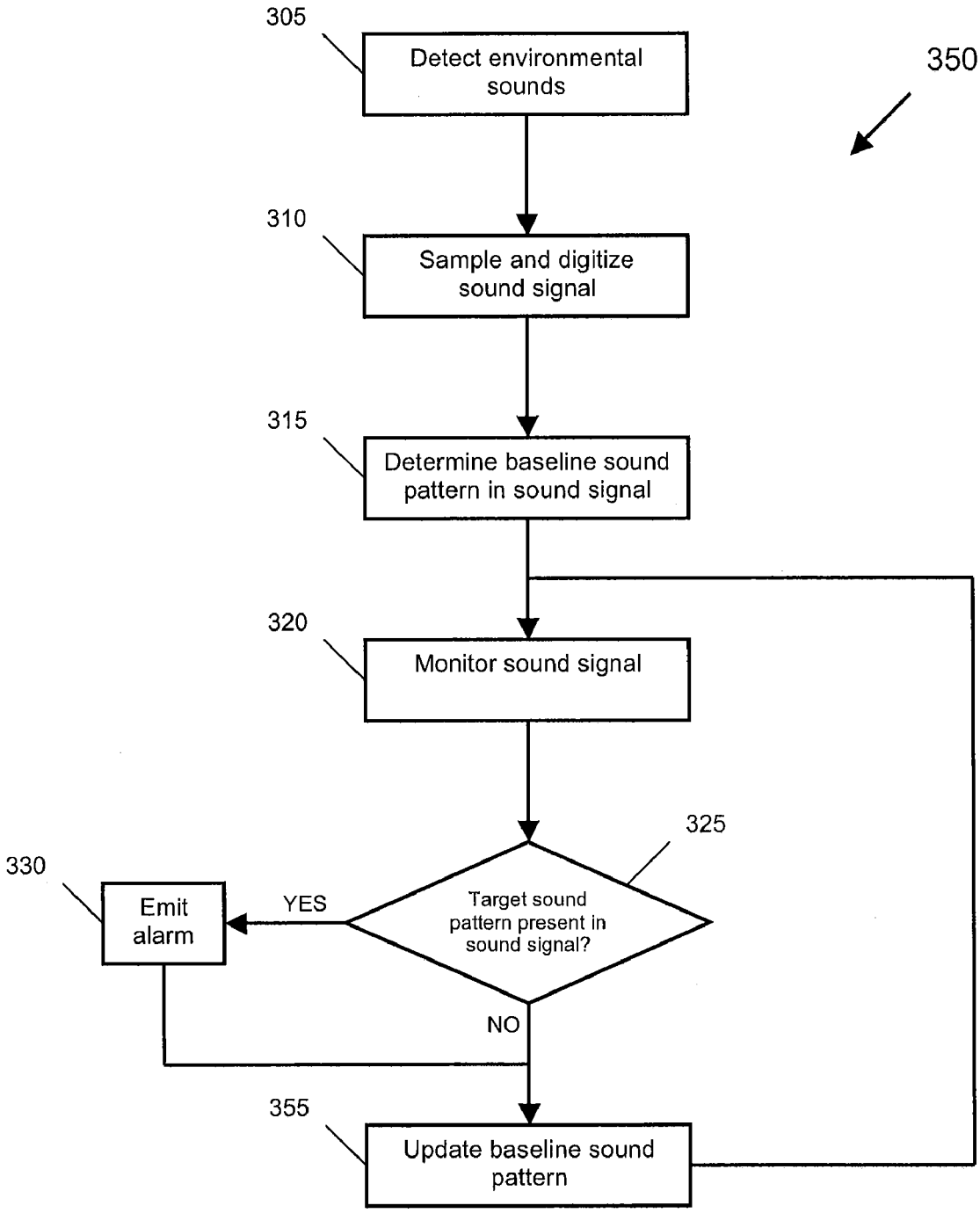
FIG. 3B is a flowchart illustrating the steps of another method for detecting an approaching sound source.

Reference is now made to FIG. 3B, which illustrates the steps of a method 350 for detecting an approaching sound source according to aspects of embodiments of the present invention. As with method 300, the steps of method 350 can be performed by any suitably configured hardware or software components. Like steps from methods 300 and 350 have also been assigned the same reference number and will only be described in as much detail as is necessary. In particular steps, method 350 differs from method 300 in the replacement of decision 335 with step 355.

Step 355 comprises continually updating the baseline sound pattern in a special case where the sound signal is analyzed at every time step of the windowing function to determine if the baseline sound pattern should be updated. (The loop in method 350 executes once per time step.) This differs from method 300 in which a new baseline sound pattern is determined only at periodic intervals, as indicated by decision 335. Of course, it should be understood that step 355 may only result in the determination of a new baseline sound pattern where new distinct sounds are resolved in the windowing function or old distinct sounds are discarded. Thus, while the parsing algorithm may be executed at every time step, it is not necessarily the case that a new baseline sound pattern will be determined.

The steps of methods 300 and 350 can be performed on computer systems using a computer program product, such as software or some other routine or compilation of machine code. The computer program product can comprise some form of non-volatile computer memory, including read-only memory (ROM), flash memory, optical discs and various types of magnetic storage devices. The non-volatile memory can store instructions for instructing the computer system to perform the steps of the methods. Use of the computer program product on the computer system, therefore, provides a way for the method to be performed. The computer system is not generally limited and may comprise a microprocessor and memory integrated directly into a portable music player. Alternatively, the microprocessor and memory can be implemented in a standalone system, such as the previously described device 1 for detecting an approaching sound source.

While certain features of embodiments of the invention have been illustrated and described herein, many modifications, substitutions, changes, and equivalents may occur to those of ordinary skill in the art. The appended claims, it should understood, are presented with the intention of covering all such modifications and changes that fall within the scope of the described invention.

The invention claimed is:

1. A method of detecting an approaching sound source comprising:

a) detecting environmental sounds and providing a sound signal representing the detected environmental sounds to a sound analyzer;

b) analyzing the sound signal to determine a baseline sound pattern comprising a plurality of distinct sounds, and storing the baseline sound pattern in memory;

c) monitoring the sound signal;

d) comparing the monitored sound signal against the baseline sound pattern stored in memory to determine whether a target sound pattern is present in the sound signal, the target sound pattern being related to the baseline sound pattern; and e) providing an alert when it is determined that the target sound pattern is present in the sound signal.

2. The method of claim 1, wherein the baseline sound pattern comprises a plurality of distinct sounds of substantially equal amplitudes and separated by time intervals all substantially equal a first time interval.

3. The method of claim 2, wherein the baseline sound pattern comprises between 3 and 5 of said distinct sounds.

4. The method of claim 2, wherein the target sound pattern comprises a second plurality of distinct sounds, wherein the distinct sounds in the second plurality of distinct sounds have increasing amplitudes and are separated by time intervals all substantially equal to a second time interval.

5. The method of claim 4, wherein the second time interval is shorter than the first time interval and the amplitude of at least one distinct sound in the second plurality of distinct sounds is less than the amplitudes of each distinct sound in the plurality of distinct sounds.

6. The method of claim 1, wherein (b) comprises determining the baseline sound pattern by detecting signal peaks in the sound signal, corresponding to distinct sounds in the sound signal, and recording an amplitude and time of each signal peak to determine a plurality of distinct sounds of substantially equal amplitudes and spaced apart in time by time intervals all substantially equal to a first time interval.

7. The method of claim 6, wherein (d) comprises determining whether the target sound pattern is present in the sound signal by determining, in the sound signal, a second plurality of signal peaks of increasing amplitudes and spaced apart in time by time intervals all substantially equal to a second time interval.

8. The method of claim 7, wherein signal peaks in the sound signal are detected using a signal windowing function and a noise threshold.

9. The method of claim 1, wherein (c) comprises continuously monitoring the sound signal over an operating time interval, and the method further comprises analyzing the monitored sound signal to determine a new baseline sound pattern, and comparing the monitored sound signal against the new baseline sound pattern to determine whether the target sound pattern is present in the monitored sound signal.

10. The method of claim 9, further comprising determining the new baseline sound pattern periodically over the operating time interval.

11. The method of claim 1, wherein (e) comprises providing at least one of an audio alert, a visual alert and a tactile alert.

12. A personal alerting device for detecting an approaching sound source comprising:

a) a detector for detecting environmental sounds and for providing a sound signal representing the detected environmental sounds;

b) a sound analyzer coupled to the detector for receiving the sound signal, wherein the sound analyzer comprises:

(i) a signal windowing function for monitoring the sound signal; and (ii) a sound pattern processor for processing the sound signal to determine a baseline sound pattern comprising a plurality of distinct sounds, and for comparing the monitored sound signal against the baseline sound pattern to determine whether a target sound pattern is present in the sound signal, the target sound pattern being related to the baseline sound pattern; and c) an output device coupled to the sound analyzer for generating an alert when the sound analyzer determines that the target sound pattern is present in the sound signal.

13. The device of claim 12, wherein the baseline sound pattern comprises a plurality of distinct sounds of substantially equal amplitudes and spaced apart in time by time intervals all substantially equal a first time interval.

14. The device of claim 13, wherein the baseline sound pattern comprises between 3 and 5 of said distinct sounds.

15. The device of claim 13, wherein the target sound pattern comprises a second plurality of distinct sounds, wherein the distinct sounds in the second plurality of distinct sounds have increasing amplitudes and are separated by time intervals all substantially equal to a second time interval.

16. The device of claim 15, wherein the second time interval is shorter than the first time interval and the amplitude of at least one distinct sound in the second plurality of distinct sounds is less than the amplitudes of each distinct sound in the plurality of distinct sounds.

17. The device of claim 12, wherein the sound analyzer further comprises a peak detector for detecting signal peaks in the sound signal, corresponding to distinct sounds in the sound signal, and the sound pattern processor determines the baseline sound pattern by recording an amplitude and time of each signal peak detected by the peak detector to determine a plurality of distinct sounds of substantially equal amplitudes and spaced apart in time by time intervals all substantially equal to a first time interval.

18. The device of claim 17, wherein the sound pattern processor determines whether the target sound pattern is present in the sound signal by determining a second plurality of distinct sounds of increasing amplitudes and spaced apart in time by time intervals all substantially equal to a second time interval.

19. The device of claim 17 wherein the sound analyzer further comprises a noise estimator for generating a noise threshold representing an estimate of background noise present in the sound signal, and the peak detector determines signal peaks in the sound signal based on the noise threshold.

20. The device of claim 12, wherein the sound analyzer continuously monitors the sound signal over an operating time interval using the signal windowing function, and the sound pattern processor processes the monitored sound signal to determine a new baseline sound pattern, and compares the monitored sound signal against the new baseline sound pattern to determine whether the target sound pattern is present in the monitored sound signal.

21. The device of claim 20, wherein the sound pattern processor determines the new baseline sound pattern periodically over the operating time interval.

22. The device of claim 12, wherein the detector comprises a microphone for converting the environmental sounds into the sound signal.

23. The device of claim 12, wherein the output device is operable to provide at least one of an audio alert, a visual alert and a tactile alert.

24. A computer program product for use on a computer system to detect an approaching sound source, the computer program product comprising a physical computer-readable recording medium, and instructions recorded on the recording medium for instructing the computer system, where the instructions are for:

a) detecting environmental sounds and providing a sound signal representing the detected environmental sounds to a sound analyzer;

b) analyzing the sound signal to determine a baseline sound pattern comprising a plurality of distinct sounds, and storing the baseline sound pattern in memory;

c) monitoring the sound signal;

d) comparing the monitored sound signal against the baseline sound pattern stored in memory to determine whether a target sound pattern is present in the sound signal, the target sound pattern being related to the baseline sound pattern; and e) providing an alert when it is determined that the target sound pattern is present in the sound signal.

* * * * *